US010219658B2

(12) United States Patent
Simmons

(10) Patent No.: US 10,219,658 B2
(45) Date of Patent: Mar. 5, 2019

(54) TOWEL HOLDER ASSEMBLY

(71) Applicant: Holly Simmons, Lula, GA (US)

(72) Inventor: Holly Simmons, Lula, GA (US)

( * ) Notice: Subject to any disclaimer, the term of this patent is extended or adjusted under 35 U.S.C. 154(b) by 277 days.

(21) Appl. No.: 15/149,956

(22) Filed: May 9, 2016

(65) Prior Publication Data

US 2017/0319019 A1 Nov. 9, 2017

(51) Int. Cl.
*A47K 10/22* (2006.01)
*A47K 10/38* (2006.01)

(52) U.S. Cl.
CPC ..... *A47K 10/22* (2013.01); *A47K 10/3836* (2013.01)

(58) Field of Classification Search
CPC ..... A47K 10/22; A47K 10/3836; A47K 2010/3253; B65H 16/005; B65H 16/021; B65H 16/023; B65H 16/04
See application file for complete search history.

(56) References Cited

U.S. PATENT DOCUMENTS

| | | | | |
|---|---|---|---|---|
| 5,887,818 | A | 3/1999 | Kelley | |
| 6,290,169 | B1 | 9/2001 | Hartley | |
| D461,669 | S | 8/2002 | Cheng | |
| 6,793,097 | B2 * | 9/2004 | Kamenstein | A47K 10/3836 221/33 |
| 6,988,691 | B1 | 1/2006 | Lai | |
| 7,278,604 | B1 | 10/2007 | Constantino | |
| D698,573 | S | 2/2014 | Carter | |
| 2009/0045083 | A1 | 2/2009 | Vaults, Jr. | |

FOREIGN PATENT DOCUMENTS

| | | |
|---|---|---|
| WO | WO9728729 | 8/1997 |

* cited by examiner

*Primary Examiner* — William E Dondero

(57) ABSTRACT

A towel holder assembly for holding paper towels and toilet paper includes a stand that may be vertically oriented on a support surface. The stand may be positioned adjacent to a sink. A pair of rollers is provided and each of the rollers is movably coupled to the stand. Thus, each of the rollers may be accessible from the sink. Each of the pair of rollers may selectively dispense an associated one of a roll of paper towels and a roll of toilet paper.

8 Claims, 5 Drawing Sheets

TOWEL HOLDER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to holder devices and more particularly pertains to a new holder device for holding paper towels and toilet paper.

BRIEF SUMMARY OF THE INVENTION

An embodiment of the disclosure meets the needs presented above by generally comprising a stand that may be vertically oriented on a support surface. The stand may be positioned adjacent to a sink. A pair of rollers is provided and each of the rollers is movably coupled to the stand. Thus, each of the rollers may be accessible from the sink. Each of the pair of rollers may selectively dispense an associated one of a roll of paper towels and a roll of toilet paper.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
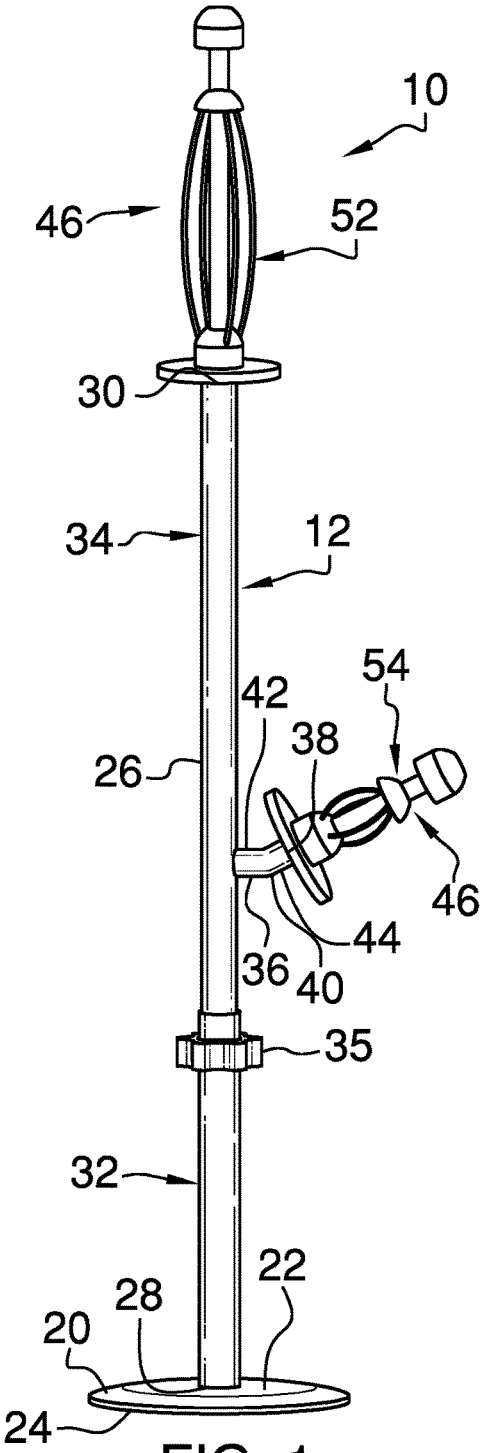
FIG. 1 is a perspective view of a towel holder assembly according to an embodiment of the disclosure.
Figure 3:
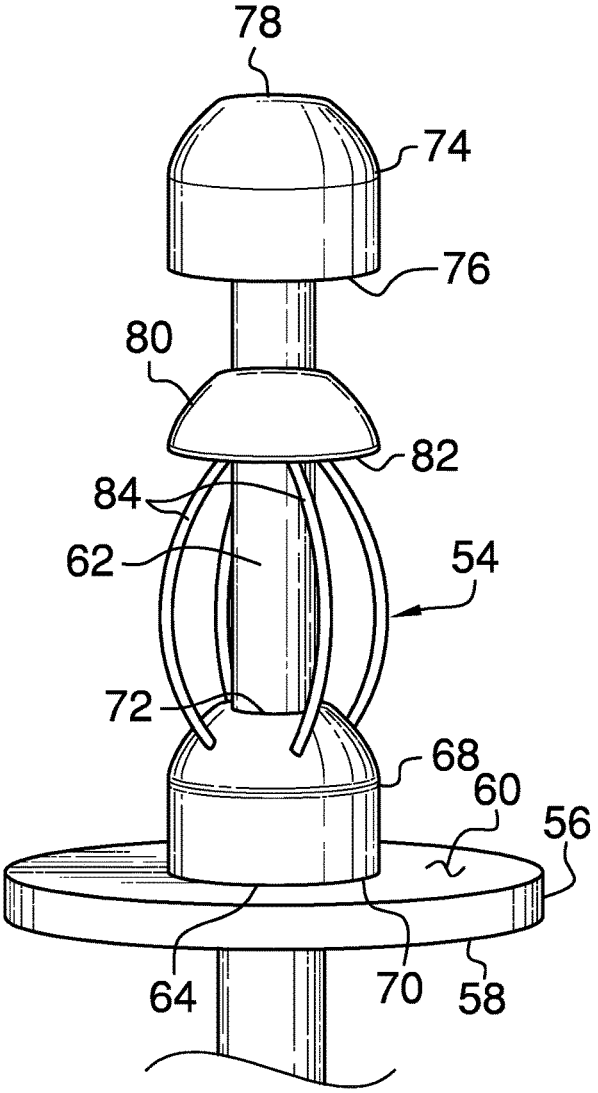
FIG. 3 is a perspective view of second roller of an embodiment of the disclosure.
Figure 2:
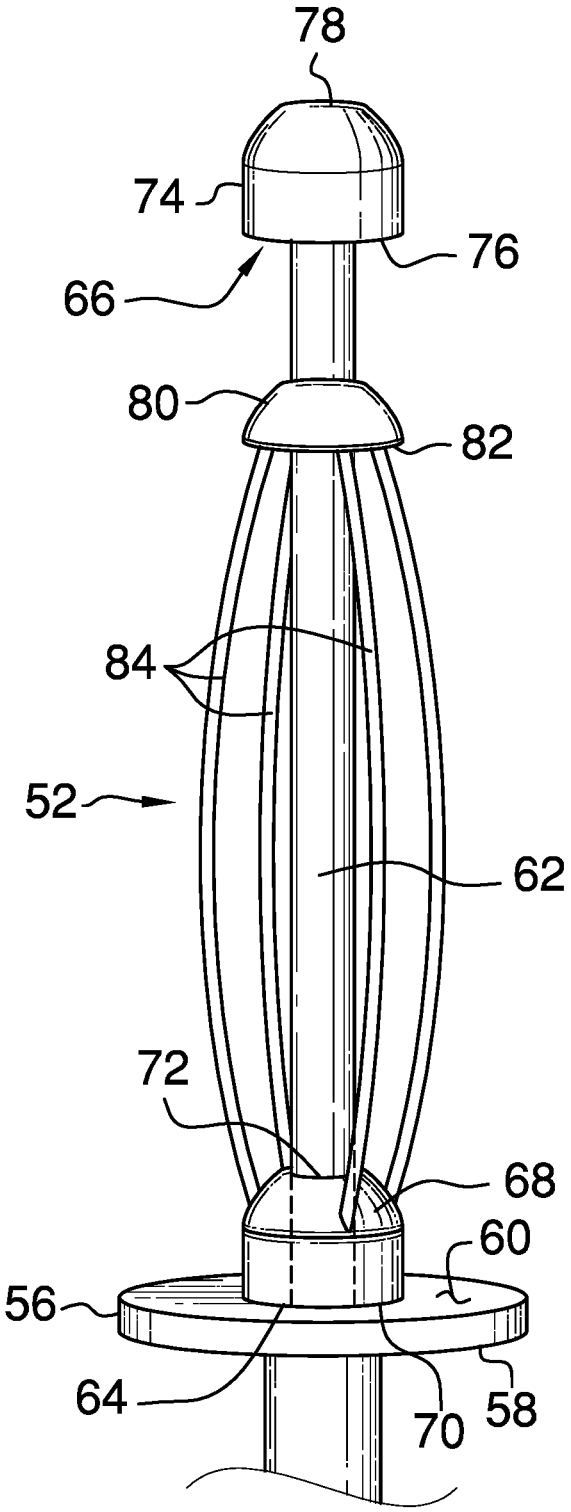
FIG. 2 is a perspective view of first roller of an embodiment of the disclosure.
Figure 4:
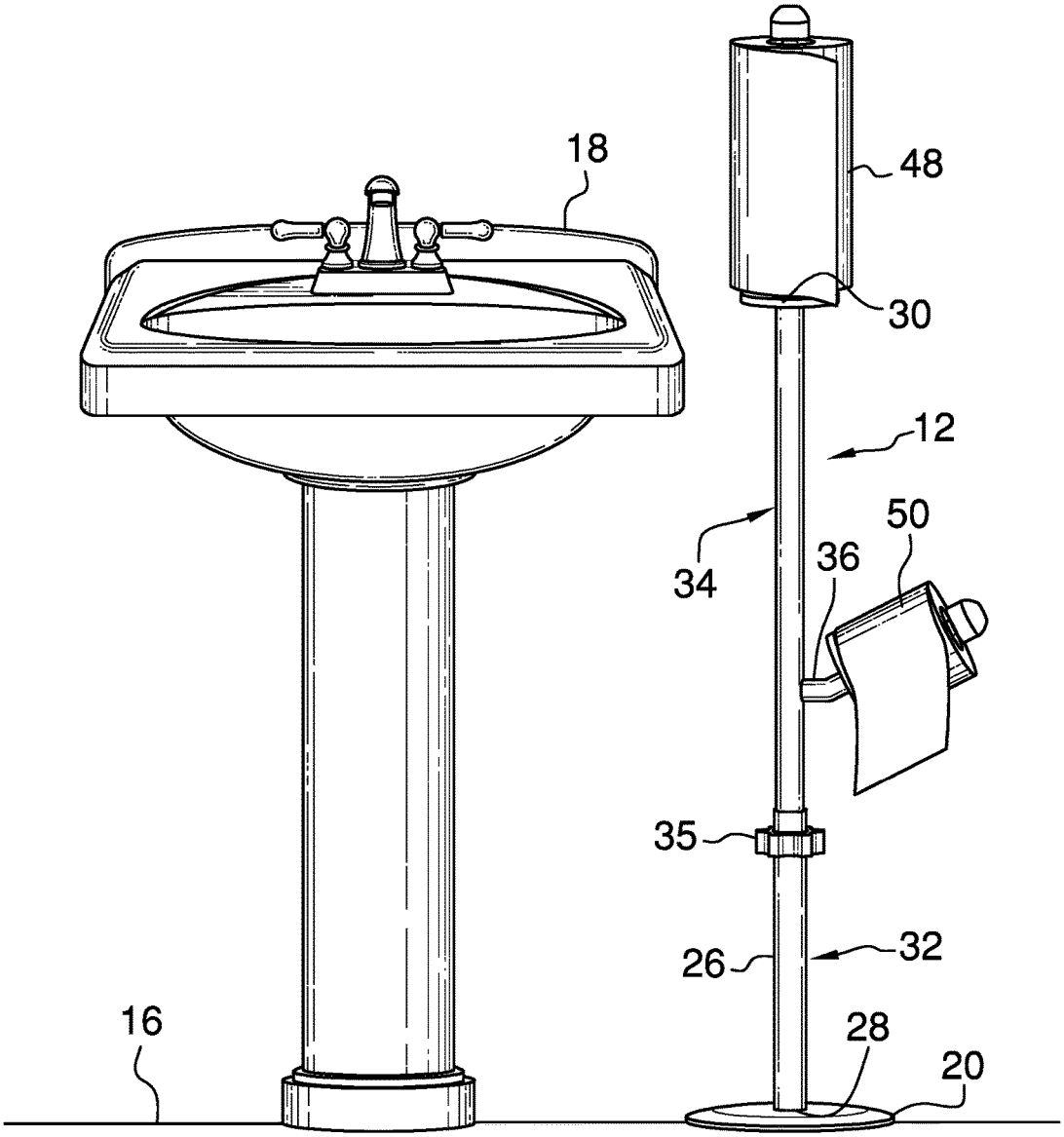
FIG. 4 is a perspective in-use view of an embodiment of the disclosure.

With reference now to the drawings, and in particular to FIGS. 1 through 6 thereof, a new holder device embodying the principles and concepts of an embodiment of the disclosure and generally designated by the reference numeral 10 will be described.

As best illustrated in FIGS. 1 through 6, the towel holder assembly 10 generally comprises a stand 12 that may be vertically oriented on a support surface 16. The stand 12 may be positioned adjacent to a sink 18. The support surface 16 may comprise a bathroom floor. The sink 18 may comprise a bathroom vanity. Moreover, the sink 18 may comprise a sink with limited counter top space.

The stand 12 comprises a base 20 that has a top side 22 and a bottom side 24. The bottom side 24 may abut the support surface 16. The base 20 may be positioned adjacent to the sink 18. A first rod 26 is provided that has a first end 28 and a second end 30. The first end 28 is coupled to the top side 22 of the base 20 and the first rod 26 extends upwardly from the base 20. Thus, the first rod 26 is vertically oriented with respect to the support surface 16.

The first rod 26 may include a lower portion 32 that is slidably coupled to an upper portion 34. Thus, the first rod 26 may have a telescopically adjustable length. A coupler 35 may be rotatably coupled around the lower portion 32. The coupler 35 may be manipulated to frictionally engage the upper portion 34. Thus, the first rod 26 may be retained at a selected length.

A second rod 36 is coupled to and extends laterally away from the first rod 26. The second rod 36 is centrally positioned on the first rod 26. The second rod 36 has a distal end 38 with respect to the first rod 26. The second rod 36 has a bend 40 thereon to define a first portion 42 of the second rod 36 forming an angle with a second portion 44 of the second rod 36.

A pair of rollers 46 is provided and each of the rollers 46 is movably coupled to the stand 12. Thus, each of the rollers 46 is accessible from the sink 18. Each of the pair of rollers 46 may selectively dispense an associated one of a roll of paper towels 48 and a roll of toilet paper 50. The pair of rollers 46 includes a first roller 52 and a second roller 54.

Each of the rollers 46 comprises a plate 56 that has a first surface 58 and a second surface 60. A shaft 62 is provided that has a primary end 64 and a secondary end 66. The primary end 64 is coupled to the second surface 60 of the plate 56. The shaft 62 is centrally positioned on the plate 56.

A first cup 68 is provided that has a bottom end 70 and a top end 72. The first cup 68 is coupled around the shaft 62 and the bottom end 70 abuts the second surface 60 of the plate 56. A second cup 74 is provided that has a lower end 76 and an upper end 78. The lower end 76 of the second cup 74 is coupled to the secondary end 66 of the shaft 62. A third cup 80 is provided that has a lowermost end 82. The shaft 62 extends through the third cup 80 such that the third cup 80 is slidable between the first cup 68 and the second cup 74.

A plurality of members 84 is provided and each of the members 84 is coupled between the lowermost end 82 of the third cup 80 and the top end 72 of the first cup 68. The members 84 are spaced apart from each other and distributed around the first cup 68 and the third cup 80. Each of the members 84 is comprised of a flexible material. Thus, each of the members 84 bows outwardly from the shaft 62 when the third cup 80 is urged toward the first cup 68.

The first surface 58 corresponding to the first roller 52 is coupled to the second end 30 of the first rod 26. The roll of paper towels 48 may be positioned on the first roller 52. Each of the members 84 corresponding to the first roller 52 frictionally engage the roll of paper towels 48 when the paper towels 48 are positioned on the first roller 52. Thus, the shaft 62 corresponding to the first roller 52 is centrally positioned in the roll of paper towels 48. The members 84 corresponding to the first roller 52 inhibit the roll of paper towels 48 from frictionally engaging the shaft 62.

The first surface 58 corresponding to the second roller 54 is coupled to the distal end 38 of the second rod 36. The roll of toilet paper 50 may be positioned on the second roller 54. Each of the members 84 corresponding to the second roller 54 frictionally engages the roll of toilet paper 50 when the toilet paper 50 is positioned on the second roller 54. Thus, the shaft 62 corresponding to the second roller 54 is centrally positioned in the roll of toilet paper 50. The members 84 corresponding to the second roller 54 inhibit the roll of toilet paper 50 from frictionally engaging the shaft 62.

Figure 5:
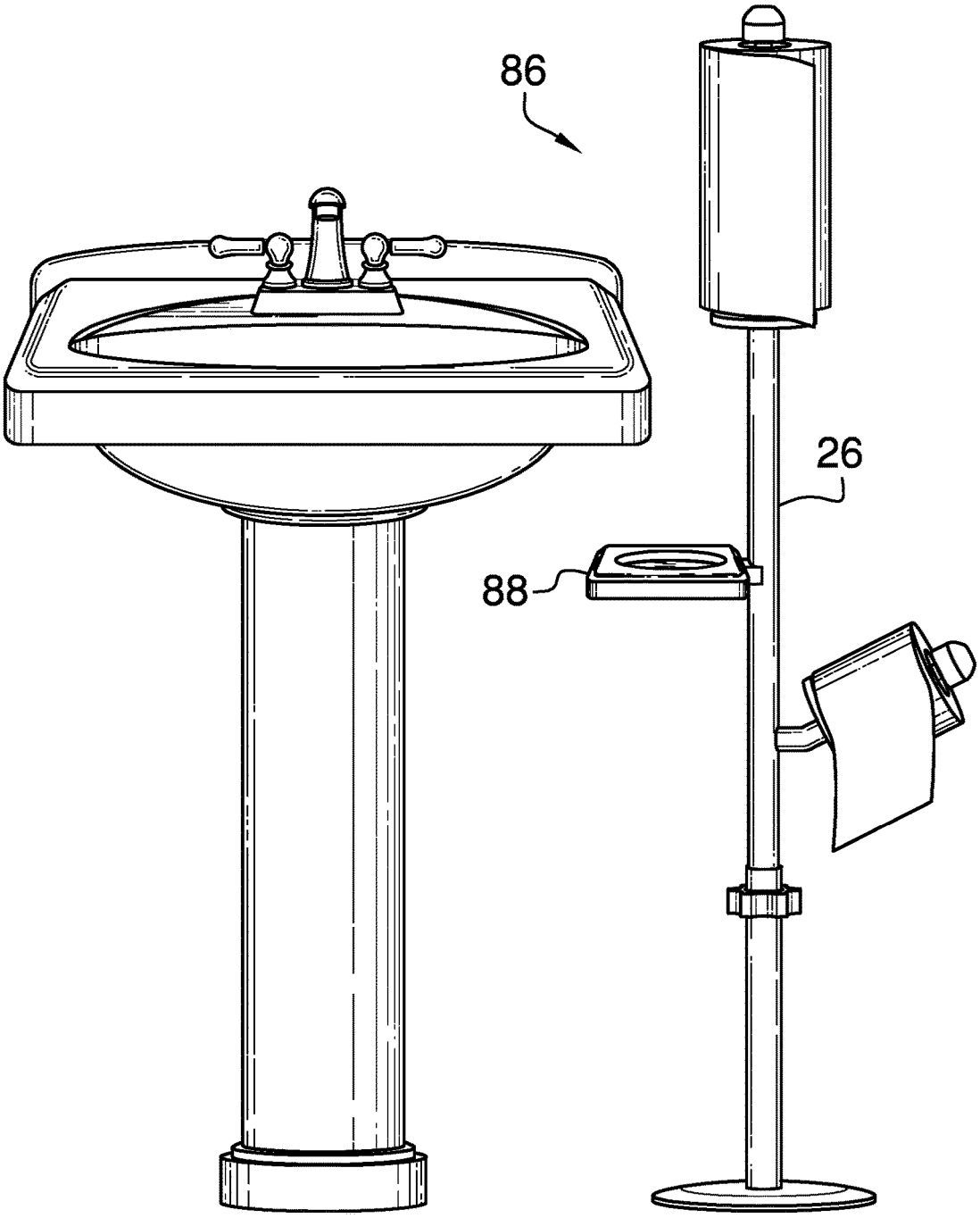
FIG. 5 is a perspective view of an alternative embodiment of the disclosure.
Figure 6:
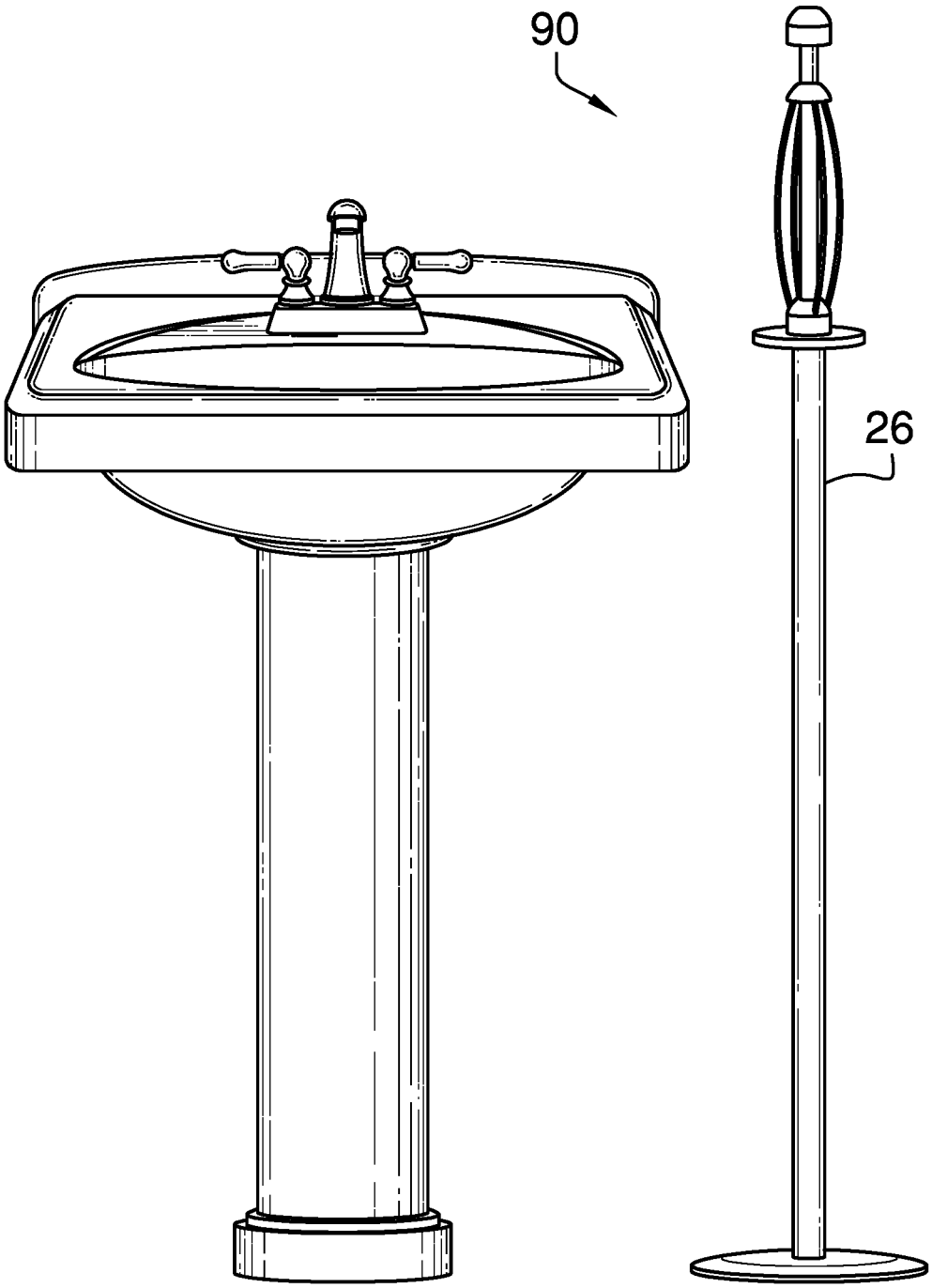
FIG. 6 is a front perspective view of an alternative embodiment of the disclosure.

In an alternative embodiment 86 as shown in FIG. 5, a soap dish 88 may be included. The soap dish 88 may be coupled to and extend laterally away from the first rod 26. The soap dish 88 may support a bar of soap or the like. Thus, bar of soap or the like may be accessible from the sink 18. In an alternative embodiment 90 as shown in FIG. 6, the second roller 54 may be absent from the first rod 26.

In use, the stand 12 is positioned adjacent to the sink 18. Thus, the stand 18 does not occupy countertop space of the sink 18. The roll of paper towels 48 is positioned on the first roller 52 and the paper towels 48 are selectively removed. The roll of toilet paper 50 is positioned on the second roller 54 and the toilet paper 50 is selectively removed. The third cup 80 corresponding to each of the rollers 46 is urged toward the first cup 68 corresponding to each of the rollers 46 through gravitational force. Thus, the members 84 corresponding to each of the rollers 46 bow outwardly to frictionally engage the associated roll of paper towels 48 and the roll of toilet paper 50.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A towel holder assembly being configured to free stand adjacent to a sink, said assembly comprising:

a stand being configured to be vertically oriented on a support surface, said stand being configured to be positioned adjacent to a sink, wherein said stand comprises a base having a top side and a bottom side, said bottom side being configured to abut the support surface, said base being configured to be positioned adjacent to the sink, a first rod having a first end and a second end, said first end being coupled to said top side of said base having said first rod extending upwardly from said base wherein said first rod is configured to be vertically oriented with respect to the support surface, a second rod being coupled to and extending laterally away from said first rod, said second rod being positioned on said first rod, said second rod having a distal end with respect to said first rod, said distal end of said second rod being a free end, said second rod having a bend thereon to define a first portion of said second rod forming an obtuse angle with a second portion of said second rod wherein said free end is directed upwardly away from said base; and a pair of rollers, each of said rollers being coupled to said stand wherein each of said rollers is configured to be accessible from the sink, each of said pair of rollers being configured to selectively dispense an associated one of a roll of paper towels and a roll of toilet paper, wherein said pair of rollers includes a first roller and a second roller, each of said rollers comprising a plate having a first surface and a second surface, and a shaft having a primary end and a secondary end, said primary end being coupled to said second surface of said plate, said shaft being centrally positioned on said plate.

2. The assembly according to claim 1, further comprising a first cup having a bottom end and a top end, said first cup being coupled around said shaft having said bottom end abutting said second surface of said plate.

3. The assembly according to claim 2, further comprising a second cup having a lower end and an upper end, said lower end of said second cup being coupled to said secondary end of said shaft.

4. The assembly according to claim 2, further comprising:

a second cup, said second cup being coupled to said secondary end of said shaft; and a third cup having a lowermost end, said shaft extending through said third cup such that said third cup is slidable between said first cup and said second cup.

5. The assembly according to claim 4, further comprising a plurality of members, each of said members being coupled between said lowermost end of said third cup and said top end of said first cup, said members being spaced apart from each other and distributed around said first cup, each of said members being comprised of a flexible material such that each of said members bows outwardly from said shaft when said third cup is urged toward said first cup.

6. The assembly according to claim 5, further comprising:

said first rod having a second end; and said first surface corresponding to said first roller being coupled to said second end of said first rod, said first roller being configured to have a roll of paper towels being positioned thereon, each of said members corresponding to said first roller being configured to frictionally engage a roll of paper towels when the paper towels are positioned on said first roller thereby facilitating said shaft corresponding to said first roller to be centrally positioned in the roll of paper towels.

7. The assembly according to claim 6, further comprising:

said second rod having a distal end; and said first surface corresponding to said second roller being coupled to said distal end of said second rod, said second roller being configured to have a roll of toilet paper being positioned thereon, each of said members corresponding to said second roller being configured to frictionally engage the roll of toilet paper when the toilet paper is positioned on said second roller thereby facilitating said shaft corresponding to said second roller to be centrally positioned in the roll of toilet paper.

8. A towel holder assembly being configured to free stand adjacent to a sink, said assembly comprising:

a stand being configured to be vertically oriented on a support surface, said stand being configured to be positioned adjacent to a sink, said stand comprising:

a base having a top side and a bottom side, said bottom side being configured to abut the support surface, said base being configured to be positioned adjacent to the sink, a first rod having a first end and a second end, said first end being coupled to said top side of said base having said first rod extending upwardly from said base wherein said first rod is configured to be vertically oriented with respect to the support surface, and a second rod being coupled to and extending laterally away from said first rod, said second rod being positioned on said first rod, said second rod having a distal end with respect to said first rod, said distal end of said second rod being a free end, said second rod having a bend thereon to define a first portion of said second rod forming an obtuse angle with a second portion of said second rod wherein said free end is directed upwardly away from said base, and a pair of rollers, each of said rollers being coupled to said stand wherein each of said rollers is configured to be accessible from the sink, each of said pair of rollers being configured to selectively dispense an associated one of a roll of paper towels and a roll of toilet paper, said pair of rollers including a first roller and a second roller, each of said rollers comprising:

a plate having a first surface and a second surface, a shaft having a primary end and a secondary end, said primary end being coupled to said second surface of said plate, said shaft being centrally positioned on said plate, a first cup having a bottom end and a top end, first cup being coupled around said shaft having said bottom end abutting said second surface of said plate, a second cup having a lower end and an upper end, said lower end of said second cup being coupled to said secondary end of said shaft, a third cup having a lowermost end, said shaft extending through said third cup such that said third cup is slidable between said first cup and said second cup, and a plurality of members, each of said members being coupled between said lowermost end of said third cup and said top end of said first cup, said members being spaced apart from each other and distributed around said first cup, each of said members being comprised of a flexible material such that each of said members bows outwardly from said shaft when said third cup is urged toward said first cup; and said first surface corresponding to said first roller being coupled to said second end of said first rod, said first roller being configured to have the roll of paper towels being positioned thereon, each of said members corresponding to said first roller being configured to frictionally engage the roll of paper towels when the paper towels are positioned on said first roller thereby facilitating said shaft corresponding to said first roller to be centrally positioned in the roll of paper towels; and said first surface corresponding to said second roller being coupled to said distal end of said second rod, said second roller being configured to have the roll of toilet paper being positioned thereon, each of said members corresponding to said second roller being configured to frictionally engage the roll of toilet paper when the toilet paper is positioned on said second roller thereby facilitating said shaft corresponding to said second roller to be centrally positioned in the roll of toilet paper.

* * * * *